US010968808B2

(12) United States Patent
Johnson

(10) Patent No.: US 10,968,808 B2
(45) Date of Patent: Apr. 6, 2021

(54) TAILPIPE RISER

(71) Applicant: Ronda Kimberly Johnson, Missouri City, TX (US)

(72) Inventor: Ronda Kimberly Johnson, Missouri City, TX (US)

( * ) Notice: Subject to any disclaimer, the term of this patent is extended or adjusted under 35 U.S.C. 154(b) by 0 days.

(21) Appl. No.: 16/573,155

(22) Filed: Sep. 17, 2019

(65) Prior Publication Data

US 2020/0088083 A1 Mar. 19, 2020

Related U.S. Application Data

(60) Provisional application No. 62/732,418, filed on Sep. 17, 2018.

(51) Int. Cl.
*F01N 13/08* (2010.01)
*B01F 13/00* (2006.01)

(52) U.S. Cl.
CPC ..... *F01N 13/082* (2013.01); *B01F 13/0052* (2013.01); *F01N 13/085* (2013.01)

(58) Field of Classification Search
CPC .... F01N 3/005; F01N 13/082; F01N 13/1827; F01N 2240/20; F01N 2270/08; F01N 2270/10; F01N 13/085; F16L 17/04; F16L 21/06; B01F 5/0666; B01F 5/0696; B01F 13/005; B01F 13/0052
USPC ..... D12/194
See application file for complete search history.

(56) References Cited

U.S. PATENT DOCUMENTS

| | | | |
|---|---|---|---|
| 2,047,378 | A | 7/1936 | Martin |
| 2,252,228 | A | 8/1941 | Koch, Jr. |
| 2,919,720 | A | 1/1960 | Nicholls |
| 3,788,072 | A | 1/1974 | Burger |

(Continued)

FOREIGN PATENT DOCUMENTS

| | | | |
|---|---|---|---|
| CN | 2835586 | Y | 11/2006 |
| CN | 106321209 | A * | 1/2017 |

(Continued)

OTHER PUBLICATIONS

Screen capture from YouTube video clip entitled "HMF Snorkel Assembly—Polaris Sportsman 600-800" 1 page, uploaded on Apr. 5, 2016 by user "HMF Exhausts". Retrieved from internet: <https://www.youtube.com/watch?v=GerPwnZoo8Y>. (Year: 2016).*

(Continued)

*Primary Examiner* — Jonathan R Matthias
(74) *Attorney, Agent, or Firm* — Jeffrey Streets; Madan Law

(57) ABSTRACT

A modular tailpipe riser kit includes a plurality of conduit modules that are selectively connectable to each other to support flow of exhaust gases through connected conduit modules. The plurality of conduit modules include a tailpipe coupling having a first end receivable and selectively securable to the outer surface of a tailpipe of an automobile, an elbow selectively connectable to the tailpipe coupling, and a riser extension selectively connectable to the elbow. The modular tailpipe riser kit further include a circumferential clamp that is receivable about the tailpipe coupling for selectively securing the tailpipe coupling about the outer surface of the tailpipe. A tailpipe riser that is fully assembled and ready for installation may also be provided.

18 Claims, 13 Drawing Sheets

(56) References Cited

U.S. PATENT DOCUMENTS

| | | | | |
|---|---|---|---|---|
| 3,964,376 | A | 6/1976 | Janke | |
| 4,136,976 | A * | 1/1979 | Leffelman | B01F 5/0682 210/335 |
| 5,351,681 | A * | 10/1994 | Hudson | B63C 11/207 128/201.11 |
| 5,609,298 | A | 3/1997 | Hyslop | |
| 6,102,076 | A | 8/2000 | Romero, Jr. et al. | |
| 2004/0007875 | A1* | 1/2004 | Bishop | F16L 21/06 285/369 |
| 2004/0238273 | A1* | 12/2004 | Fritskey | F01N 13/1844 181/264 |
| 2005/0006901 | A1* | 1/2005 | Umiastowski | F01N 13/08 285/404 |
| 2006/0123774 | A1* | 6/2006 | Kang | F01N 3/005 60/309 |

FOREIGN PATENT DOCUMENTS

| | | | | |
|---|---|---|---|---|
| CN | 206593121 | U * | 10/2017 | |
| FR | 2506422 | A1 * | 11/1982 | F16L 21/08 |

OTHER PUBLICATIONS

Machine translation of CN-206593121-U, accessed Nov. 24, 2020. (Year: 2020).*

Machine translation of CN-106321209-A, accessed Nov. 24, 2020. (Year: 2020).*

W.J. Tone, "U.S. Pat. No. 501,812 'Thill Coupling Attachment'", Patented Jul. 18, 1893, 3 Pages including Figures 1-2.

R. Mancha, "U.S. Pat. No. 726,081 'Illuminating Device'", Patented Apr. 21, 1903, 3 Pages including Figures 1-5.

F. Cook, "U.S. Pat. No. 351,579 'Cuff Button'", Patented Oct. 26, 1886, 2 Pages including Figures 1-4.

Song, Lijun, "Chinese Patent CN2835586Y 'Water Intake Preventer for Automobile Exhaust Port'", Patented Nov. 8, 2006, Espacenet english translation, 1 Page.

Screen capture from www.hmfracing.com entitled "Polaris Sportsman 600 Exhaust Systems" 1 page, retrieved by Applicant from internet: <https://www.hmfracing.com/exhausts/polaris/sportsman-600/customize?customize=true> on Aug. 30, 2020.

Screen capture from www.hmfracing.com entitled "Polaris Sportsman 600 Snorkel" 1 page, retrieved by Applicant from Internet: <https://www.hmfracing.com/parts/snorkels/polaris-sportsman-600-snorkel> on Aug. 30, 2020.

Screen capture from www.hmfracing.com entitled "Polaris Sportsman 600 Snorkel Instructions" 1 page, retrieved by Applicant from internet: <https://www.hmfracing.com/parts/snorkels/polaris-sportsman-600-snorkel/installation> on Aug. 30, 2020.

Screen capture from www.hmfracing.com entitled "Swamp Snorkel Kit Universal Installation Instructions" 1 page, retrieved by Applicant from internet: <https://www.hmfracing.com/files/products/universal-swamp-snorkel.pdf> on Aug. 30, 2020.

* cited by examiner

TAILPIPE RISER

CROSS-REFERENCE TO RELATED APPLICATIONS

This application claims the benefit of U.S. Provisional Patent Application Ser. No. 62/732,418 filed on Sep. 17, 2018, which application is incorporated by reference herein.

BACKGROUND

The present disclosure relates to an apparatus for preventing water intrusion into an automotive tailpipe when driving through water that would otherwise cover the tailpipe.

BACKGROUND OF THE RELATED ART

An internal combustion engine controls the combustion of a fuel with air in a combustion chamber where combustion of the fuel and air may be ignited either with a spark or compression. Expansion of the combustion gases provide the force is converted in mechanical energy that moves the automobile. However, to support the combustion process, air must pass from the environment into an intake manifold and the exhaust gases must be expelled through an exhaust system to the tailpipe for release into the environment.

If the automobile is driven through water, either by crossing a stream or driving down a flooded street, the automobile may stall if high water enters either the air intake of tailpipe. Since the tailpipe is generally located a lower position on the automobile than the air intake, the tailpipe may be more likely to take on water. As long as the automobile remains in motion, the force of the exhaust gases being pushed out of the tailpipe may prevents water from entering the tailpipe. However, if the automobile comes to a stop, the force is reduced and water may enter the tailpipe. If the water gets into the engine, the automobile will no longer be drivable and the driver is stranded in high water. Furthermore, when there is traffic along a flooded street, the first car to stall may cause block the path of other cars such that a long line of cars may come to a stop and stall out. In this situation, even emergency vehicles, such as ambulances and other rescue vehicles, may be subject to the same risk of stalling.

BRIEF SUMMARY

Some embodiments provide a modular tailpipe riser kit comprising a plurality of conduit modules, wherein each conduit module is selectively connectable to at least one other conduit module to support flow of exhaust gases through connected conduit modules. The plurality of conduit modules include: a tailpipe coupling having a first end and a second end, wherein the first end is receivable and selectively securable to the outer surface of a tailpipe of an automobile; an elbow having a first end and a second end, wherein the first end of the elbow is selectively connectable to the second end of the tailpipe coupling; and a riser extension having a first end and a second end, wherein the first end of the riser extension is selectively connectable to the second end of the elbow. The modular tailpipe riser kit may further comprise a circumferential clamp that is receivable about the tailpipe coupling for selectively securing the tailpipe coupling about the outer surface of the tailpipe.

Some embodiments provide a tailpipe riser comprising a conduit having a first end that forms a tailpipe coupling that is receivable and selectively securable to the outer surface of a tailpipe of an automobile, an intermediate section that bends upward and extends to a second end at an elevation above a bumper of the automobile, and a circumferential clamp that is receivable about the tailpipe coupling for selectively securing the tailpipe coupling about the outer surface of the tailpipe.

DETAILED DESCRIPTION

Figure 1:
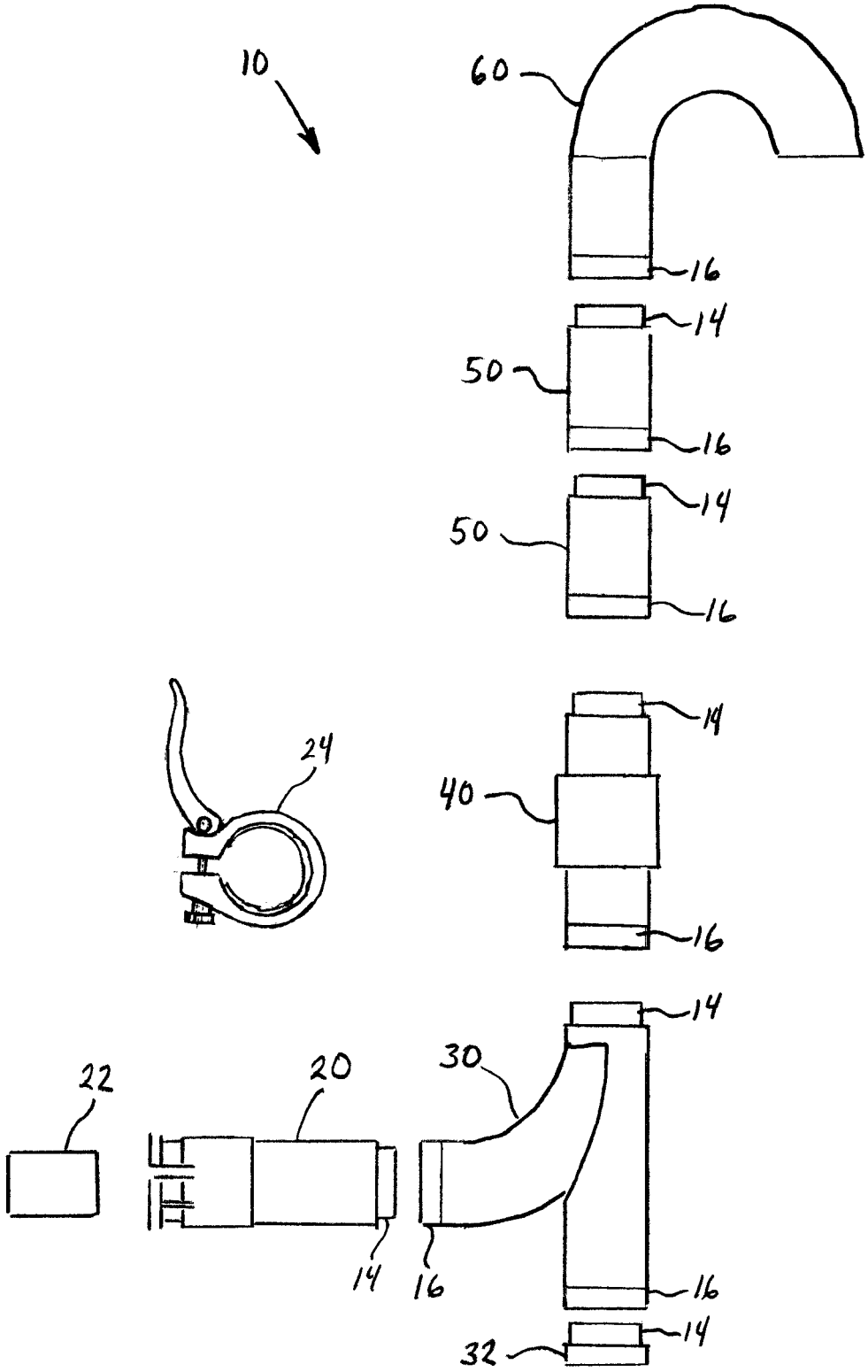
FIG. 1 is an assembly diagram of component parts included in a kit for assembling a modular tailpipe riser.

Some embodiments provide a modular tailpipe riser kit comprising a plurality of conduit modules, wherein each conduit module is selectively connectable to at least one other conduit module to support flow of exhaust gases through connected conduit modules. The plurality of conduit modules include: a tailpipe coupling having a first end and a second end, wherein the first end is receivable and selectively securable to the outer surface of a tailpipe of an automobile; an elbow having a first end and a second end, wherein the first end of the elbow is selectively connectable to the second end of the tailpipe coupling; and a riser extension having a first end and a second end, wherein the first end of the riser extension is selectively connectable to the second end of the elbow. The modular tailpipe riser kit may further comprise a circumferential clamp that is receivable about the tailpipe coupling for selectively securing the tailpipe coupling about the outer surface of the tailpipe.

While it is generally inadvisable to drive an automobile through water of an unknown depth, there may be occasions when it is necessary to drive through a familiar street that has flooded in order to escape rising water levels that pose an even greater danger. For example, after watching a pickup truck drive through a low lying flooded street, it may be possible to assess that the water is not so deep as to pose a personal danger to the driver of a typical sedan but may be deep enough to submerse the open end of the tailpipe. If an automobile comes to a stop with its tailpipe submersed in water, it is possible that the automobile will stall due to water being sucked into the engine through the tailpipe.

Some embodiments of the modular tailpipe riser may be quickly and easily assembled and installed as the need arises, and may also be just as quickly and easily removed and disassembled when no longer needed. Some embodiments may be assembled and installed without requiring the use of tools. Furthermore, some embodiments may be stored in a trunk or other compartment of an automobile, such as in the same compartment as a spare tire and/or tire jack. Accordingly, the modular tailpipe riser is extremely portable so that it is accessible in a time of need.

Embodiments of the modular tailpipe riser may be use on wide variety of automobile types and sizes, including various makes and models of cars and trucks. For example, the modular tailpipe riser may be a critical piece of equipment for emergency rescue vehicles. In some embodiments, one or more of the conduit modules of the modular tailpipe riser may have a different size of shape in order to fit on a particular automobile or range of automobiles. Optionally, the coupling design may be customized to facilitate connection to tailpipes of various diameters or non-cylindrical shapes. Still further, the various conduit modules may have various lengths to reach the tailpipe and/or to achieve a desired elevation of the riser opening.

A conduit is a structure, including pipes, tubes and ducts, with a passageway there through that can be used to convey a gas or fluid. A conduit may have a tubular shape or cylindrical cross-section, but may have other shapes such as a rectangular, oval, or irregular cross-section. Embodiments of the modular tailpipe riser kit may include conduit modules having various shapes and sizes (i.e., lengths, widths and other dimensions). In some embodiments, each of the conduit modules may have at least one portion with a tubular cross-section, whereas other embodiments may have one or more conduit modules having a rectangular, oval, or irregular cross-section. Regardless of the shape and size, each conduit module may be selectively connectable to at least one other conduit module to support flow of exhaust gases through the connected conduit modules. Optionally, the plurality of conduit modules are made of a polymeric material or polymer-containing composite, such as selected from polyimide, polypropylene, polyethylene, or copolymers of propylene and ethylene.

The modular tailpipe riser kit may be used to form a conduit that is extendable and redirectable by selectively connecting one conduit module to another, either in a predetermined order or as desired for a particular situation or installation. For example, a modular tailpipe kit may include conduit modules that are predetermined to be suitable to assemble into a tailpipe riser adapted for a particular make and/or model of an automobile. Alternatively, a modular tailpipe riser kit may include conduit modules that are generally suitable to assemble into a tailpipe riser for a wide range of automobile makes and/or models. In some embodiments, the conduit modules in a modular tailpipe riser kit may be assembled in a first order for installation on a first automobile or in a second order for installation on a second automobile. In some embodiments, a first subset of the conduit modules in a modular tailpipe riser kit may be assembled for installation on a first automobile or a second subset of the conduit modules in the modular tailpipe riser kit may be assembled for installation on a second automobile. Optionally, the modular tailpipe riser kit may include a plurality of riser extensions that may be used interchangeably to extend the elevation of the tailpipe riser. In some embodiments, the conduit modules may be assembled and secured to the tailpipe to extend the conduit behind the automobile and upward behind the automobile to a height above a bumper on the automobile. Some additional tailpipe riser height may be further beneficial for preventing water intrusion in deeper water, but a tailpipe riser height greater than the elevation of the air intake to the engine may not be of further benefit since any water entering the air intake will stall the automobile even if water has not entered the tailpipe.

Embodiments of the modular tailpipe riser kit may have conduit modules that are selectively connectable using various fastening types. For example, two adjacent conduit modules may have mating screw threads, such that the two conduit modules may be selectively connected by aligning and turning one conduit module relative to the other. Alternative embodiments may include conduit modules that are selectively connectable using slip joint fittings, interference fit joints, or other conduit fasteners or conduit connection types.

In some embodiments of the modular tailpipe riser kit, the tailpipe coupling may have a first end including a plurality of deflectable fingers spaced about a circumference of the tailpipe coupling, wherein the circumferential clamp is receivable around the plurality of deflectable fingers. Optionally, the plurality of deflectable fingers may collectively form a circumferential groove for securing the circumferential clamp in a position around the plurality of deflectable fingers. Furthermore, the modular tailpipe riser kit may include a compressible tubular gasket that may be disposed between the inner surfaces of the deflectable fingers and the outer surface of the tailpipe, such that closing the circumferential clamp biased the deflectable fingers inwardly toward the tailpipe such that the compressible tubular gasket is compressed to form a water tight seal between the tailpipe and the tailpipe coupling. In a further option, the circumferential clamp may be manually operable between an open condition and a closed condition without tools and the plurality of conduit modules are manually connectable without tools.

In some embodiments, the elbow forms a curve between the first and second ends. For example, if a first end of the elbow is in a substantially horizontal orientation for connecting to the tailpipe coupling, then a second end of the elbow may be in a substantially vertical orientation for connecting to an upwardly extending conduit module. Some embodiments of the elbow may form a 90 degree angle between the orientation of the first end and the second end, but other embodiments may form alternative angles, such as an angle between 75 degrees and about 105 degrees.

In some embodiments, the elbow may include a knockout chamber that extends downward from the second end of the elbow to collect water. Water that enters the top of the modular tailpipe riser and drops down into the top of the elbow through the second end may subsequently drop down into the knockout chamber rather than running along the curved portion of the elbow toward the tailpipe. In one option, the knockout chamber may have a downward distal end that is selectively sealed off by a removable drain plug. Accordingly, water collecting in the knockout chamber may be emptied out once the automobile is out of the high water without having to disassemble or uninstall the modular tailpipe riser.

Some embodiments of the modular tailpipe riser kit may further include an agitator module having a structure that removes water from the riser. One such agitator module includes a ball cage and a hollow perforated ball retained within the ball cage. The ball cage may be designed so that the hollow perforated ball is able to move within the ball cage without escaping the ball cage. In one example, the ball cage includes a plurality of ribs radially inwardly extending from the internal side wall of the agitator, wherein the inward facing surface of each rib is concave between a first distal end and a second distal end.

Some embodiments of the modular tailpipe riser kit may further include a weatherhead having a first end selectively connectable to the riser extension, wherein the weatherhead is curved to have a second end that is downwardly facing to deter rain drops from entering the modular tailpipe riser. In some configurations, the weatherhead may be referred to as a down pipe. Optionally, the weatherhead may include a screen or grate secured across the second end of the weatherhead to further deter water, debris or other objects from entry into the tailpipe riser.

Some embodiments provide a tailpipe riser comprising a conduit having a first end that forms a tailpipe coupling that is receivable and selectively securable to the outer surface of a tailpipe of an automobile, an intermediate section that bends upward and extends to a second end at an elevation above a bumper of the automobile, and a circumferential clamp that is receivable about the tailpipe coupling for selectively securing the tailpipe coupling about the outer surface of the tailpipe.

Embodiments of the tailpipe riser may include any one or more conduit modules or features of the modular tailpipe riser kit described herein. However, some embodiments of the tailpipe riser may a preassembled modular tailpipe riser that can be disassembled as described in reference to the modular tailpipe riser, and some embodiments of the tailpipe riser may be made in a manner that cannot be disassembled.

In some embodiments of the tailpipe riser, the tailpipe coupling has a first end having a plurality of deflectable fingers spaced about a circumference of the tailpipe coupling, wherein the plurality of deflectable fingers form a circumferential groove for securing the circumferential clamp in a position around the plurality of deflectable fingers. Some embodiments of the tailpipe riser further include a knockout chamber that extends downward below the elevation of the tailpipe to collect water that enters the conduit, and a drain plug, wherein the knockout chamber has a downward distal end that is selectively sealed off by the drain plug. In some further embodiments, the tailpipe riser may include a ball cage disposed in an upwardly extending portion of the intermediate section of the conduit, and a hollow perforated ball retained within the ball cage, wherein the hollow perforated ball is able to move within the ball cage without escaping the ball cage. In some still further embodiments, the tailpipe riser may include a weatherhead having a first end selectively connectable to the riser extension, wherein the weatherhead is curved to have a second end that is downwardly facing to deter rain drops from entering the modular tailpipe riser.

FIG. 1 is an assembly diagram of component parts included in a kit 10 for assembling a modular tailpipe riser. The kit 10 shown in FIG. 1 includes a tailpipe coupling 20, a compressible tubular gasket 22, and a circumferential clamp 24, such as a tube clamp or hose clamp. The kit 10 further includes an elbow 30, an agitator 40, a pair of riser extensions 50, and a weatherhead 60, where the elbow 30 includes a drain plug 32. The conduit modules 20, 30, 40, 50, 60 are arranged in an order or configuration that, once assembled in this manner, would form merely one non-limiting example of a modular tailpipe riser. Each of the conduit modules 20, 30, 40, 50, 60 are generally hollow along a central axis to allow exhaust gases from the automobile to pass through each conduit module from the tailpipe coupling 20 to the weatherhead 60 for release into the surrounding environment. Furthermore, the conduit modules 20, 30, 40, 50, 60 are selectively connectable. As shown, each the conduit modules 20, 30, 40, 50, 60 include at least one end have screw threads, such as external screw threads 14 and internal screw threads 16 that are selectively connectable with the external screw threads 14.

Figure 2:
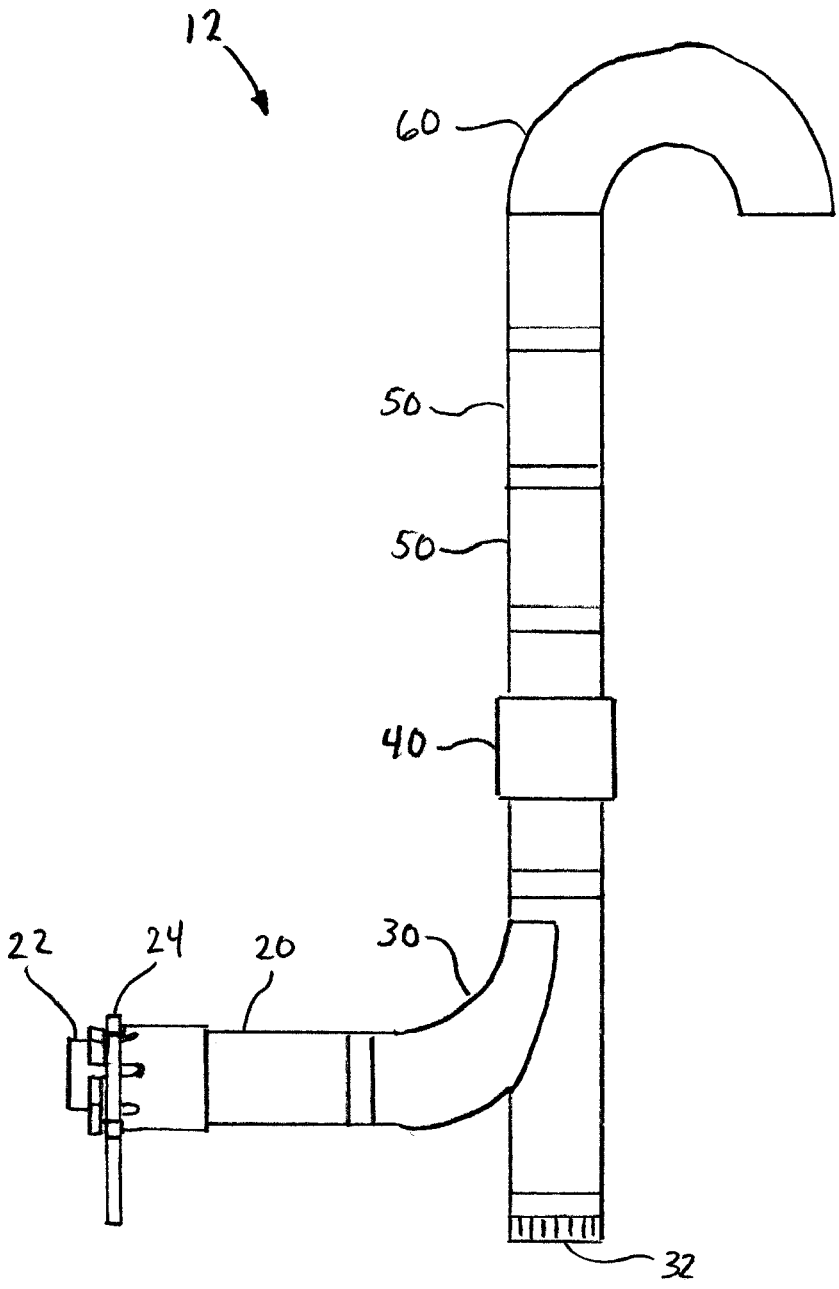
FIG. 2 is a diagram of a modular tailpipe riser that has been fully assembled.

FIG. 2 is a diagram of a modular tailpipe riser 12 that has been fully assembled using the components of the modular tailpipe riser kit 10 shown in FIG. 1. Where the conduit modules 20, 30, 40, 50, 60 are selectively connectable with screw threads, any two adjacent conduit modules are selectively connected by aligning the two modules are turning one module relative to the other module about a central axis to cause the external screw threads 14 of one module to be drawn into the internal screw threads 16 of the other module until shoulders of the two modules are in abutment. FIG. 2 also illustrates the tubular gasket 22 inserted into the end of the tailpipe coupling 20 and the circumferential clamp 24 securely received in a groove around the circumference of the tailpipe coupling 20. Although the modular tailpipe riser 12 is fully assembled, it has not yet been installed relative to a tailpipe of an automobile.

Figure 3:
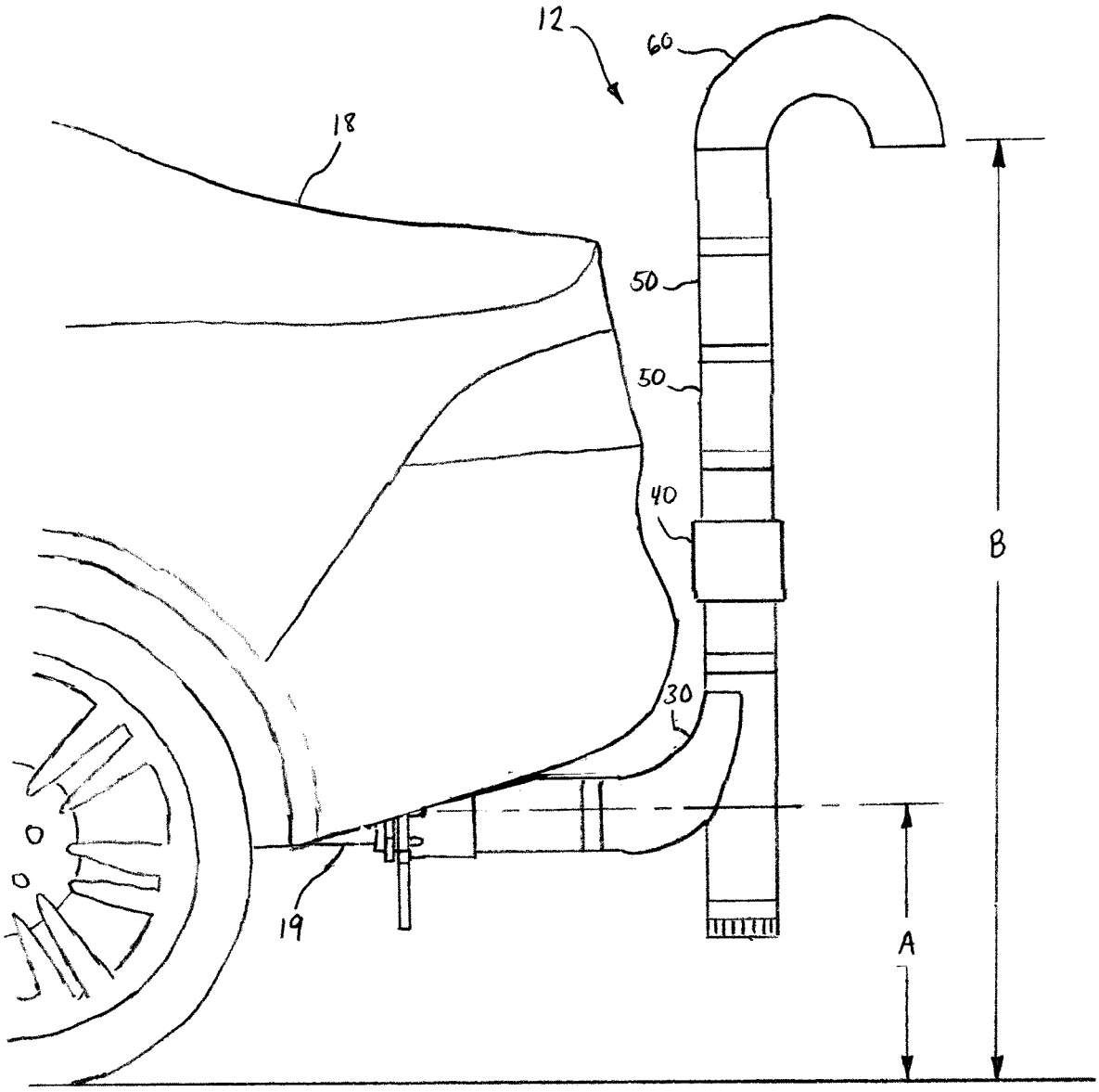
FIG. 3 is a diagram of the modular tailpipe riser that has been installed on an automobile by connecting the modular tailpipe riser to the tailpipe of an automobile.

FIG. 3 is a diagram of the modular tailpipe riser 12 that has been installed on an automobile 18 by connecting the modular tailpipe riser 12 to the tailpipe 19 of the automobile 18. Whereas the exhaust gases coming directly out of the tailpipe 19 would normally be released at an elevation "A", the modular tailpipe riser 12 seals to the tailpipe 19, redirects the exhaust gases upwardly through the modular tailpipe riser 12, and releases the exhaust gases from the weatherhead 60 at an elevation "B". Water of elevation A in a roadway might enter the tailpipe 19 without the modular tailpipe riser 12. However, with the modular tailpipe riser 12 installed as shown, the water elevation would have to reach elevation B before being able to enter the tailpipe 19. Accordingly, at many different water depths, the modular tailpipe riser 12 enables the automobile to continue operation in order to being the driver and other occupants to safety.

Figure 4A:
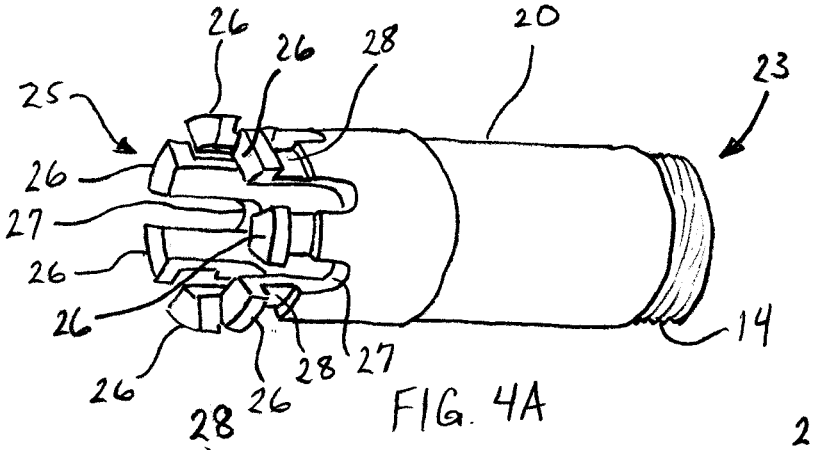
FIGS. 4A-C are diagrams that provide a perspective view, side view, and cross-sectional side view, respectively, of a coupling that is configured to be secured to the tailpipe of an automobile and support the modular tailpipe riser.
Figure 4B:
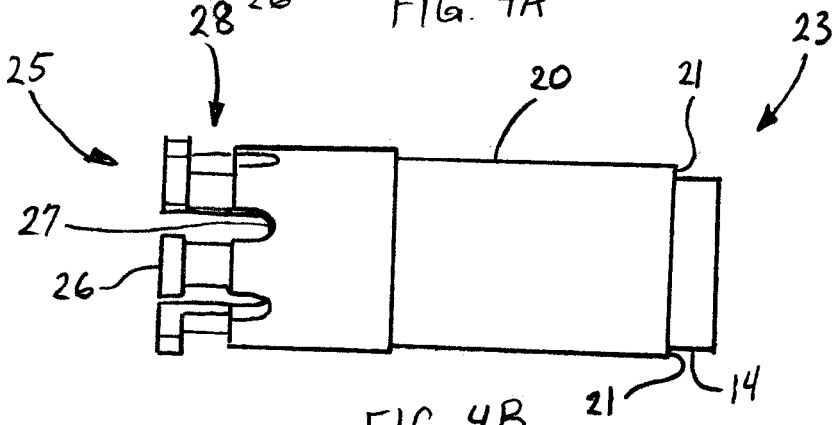
Figure 4C:
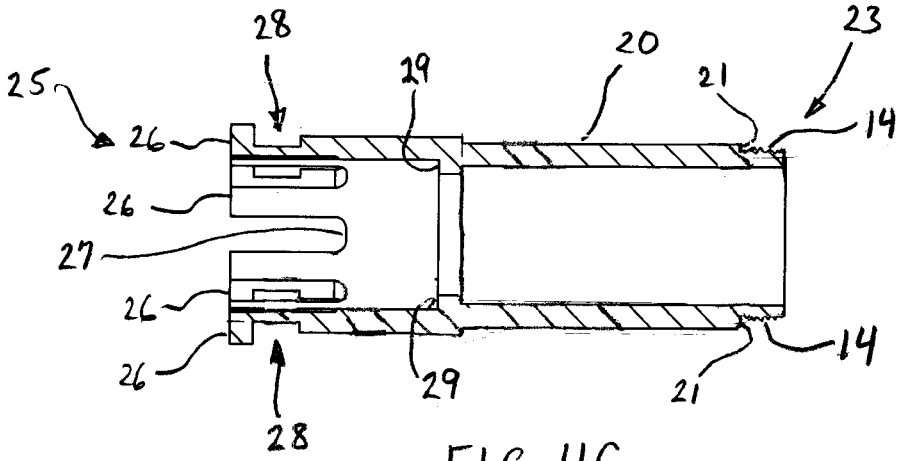

FIGS. 4A-C are diagrams that provide a perspective view, side view, and cross-sectional side view, respectively, of a tailpipe coupling 20 that is configured to be secured to the tailpipe of an automobile and support the modular tailpipe riser. In the embodiment shown, the tailpipe coupling 20 has a first end 25 have a plurality of deflectable fingers 26 (seven shown) spaced about the circumference of the tailpipe coupling 20. The relief cuts 27 between the fingers 26 facilitates the deflectability of the fingers 26. The plurality of fingers 26 also include a circumferential groove 28 that is sized to receive the circumferential clamp 24 (see FIG. 1). This groove 28 may be more clearly seen in FIG. 4B. A second end 23 of the tailpipe coupling 20 includes external screw threads 14 and a shoulder 21. FIG. 4C is a cross-sectional side view that illustrates that the tailpipe coupling 20 has a central passageway that is open to exhaust gas flow, yet forms a tailpipe stop or shoulder 29 that limits how far the tailpipe is received into the tailpipe coupling 20.

Figure 5A:
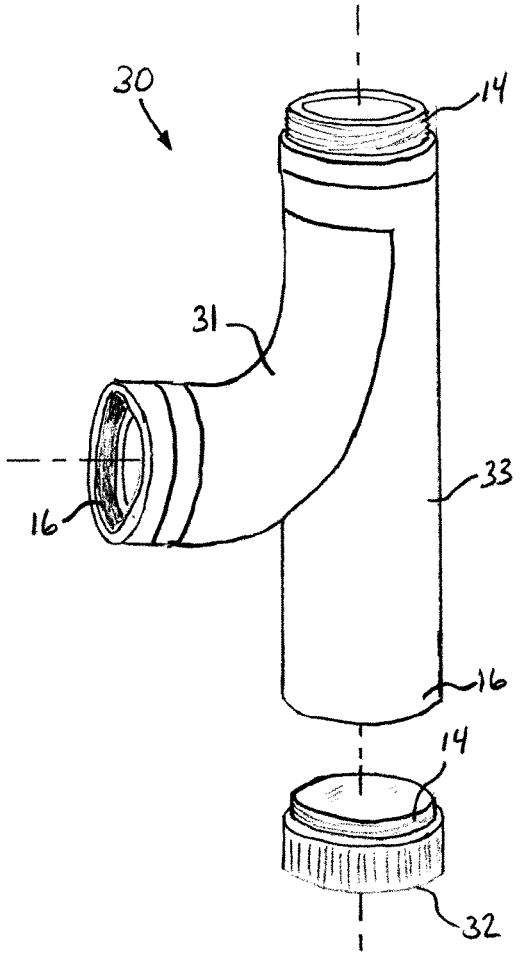
FIGS. 5A-B are diagrams that provide a perspective view and a cross-sectional side view, respectively, of an elbow having a water knockout branch.
Figure 5B:
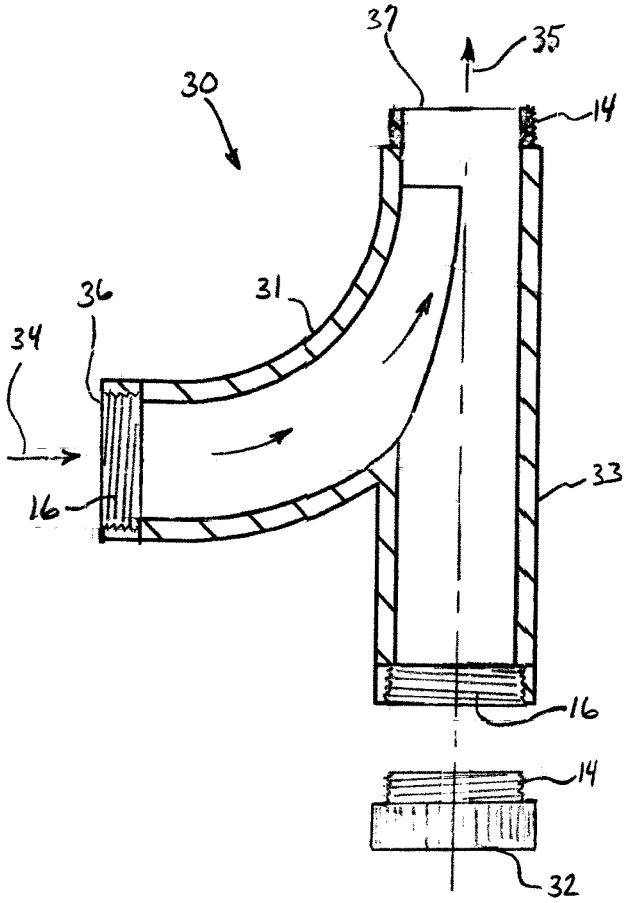

FIGS. 5A-B are diagrams that provide a perspective view and a cross-sectional side view, respectively, of an elbow 30 having both a curved branch 31 and a water knockout chamber or branch 33. The curved branch 31 redirects a flow of exhaust gases through the tailpipe coupling 20 from a horizontal direction (see horizontal arrow 34) at a first end 36 to an upward or vertical direction (see upward arrow 35) at a second end 37. Conversely, any water droplets entering the second end 37 of the elbow 30 may fall into the knockout chamber or branch 33, which has limited but useful capacity for accumulation of water. Of course, when driving through water, the drain plug 32 must be selectively connected to the knockout chamber 33. However, once the automobile has been driven out of the high water, the drain plug 32 may be disconnected temporarily to remove any water that has accumulated in the knockout chamber 33.

Figure 6A:
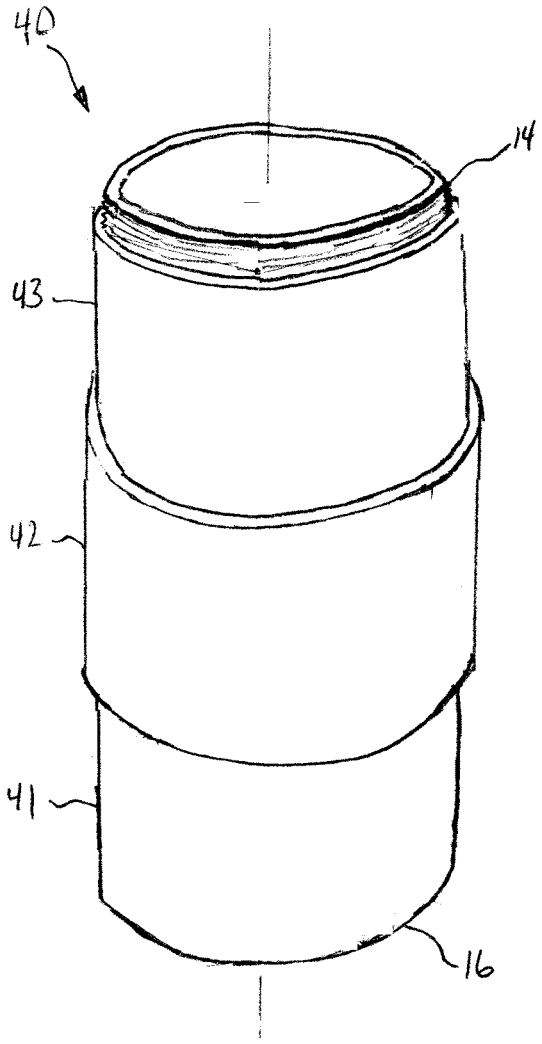
FIGS. 6A-B are diagrams that provide a perspective view and a partial cut-away perspective view, respectively, of an agitator for expelling water droplets.
Figure 6B:
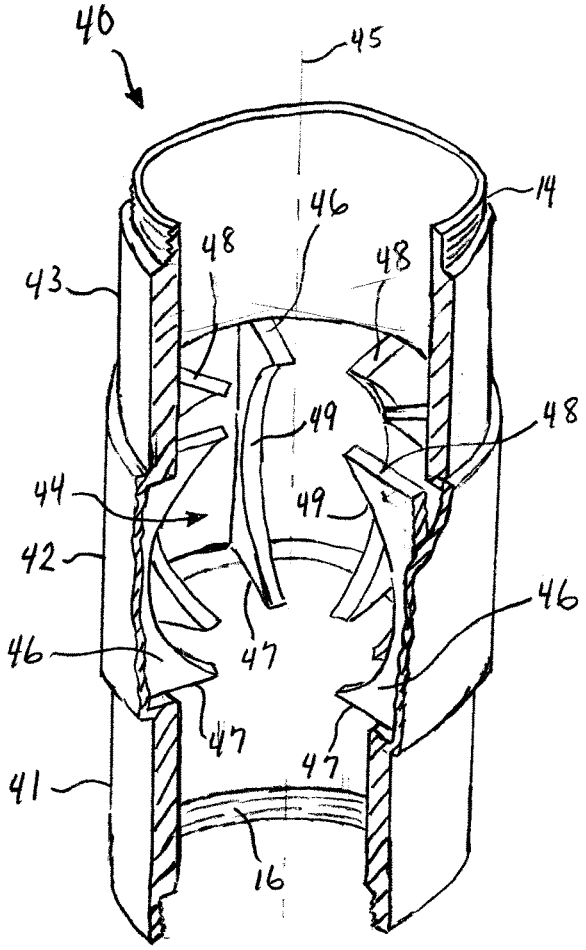

FIGS. 6A-B are diagrams that provide a perspective view and a partial cut-away perspective view, respectively, of an agitator 40 (without its hollow, perforated ball; see FIG. 7A) for expelling water droplets. As shown in FIG. 6A, the agitator 40 has a first end 41 having internal screw threads 16, an intermediate section 42, and a second end 43 having external screw threads 14. The screw threads at the first and second ends 41, 43 enable the agitator 40 to be selectively connected to adjacent conduit modules, preferably in an upright section of the modular tailpipe riser.

In reference to the partial cut-away perspective view of FIG. 6B, the intermediate section 42 have a plurality of radially inwardly-directed ribs that are spaced apart about the inside surface of the intermediate section 42. While six ribs are shown, a seventh rib has been removed as part of the cut-away to facilitate viewing of the other ribs 46. Each rib 46 may be parallel to, or insect with, an axial centerline 45 of the agitator 40. Furthermore, each rib 46 has a first end 47, a second end 48, and an inwardly facing surface 49 between the first and second ends 47, 48 that is concave. Collectively, the plurality of ribs 46 form a ball cage 44. Note that there are gaps between the ribs 46 that allow exhaust gases to pass between the ribs from one end of the agitator to the other.

Figure 7A:
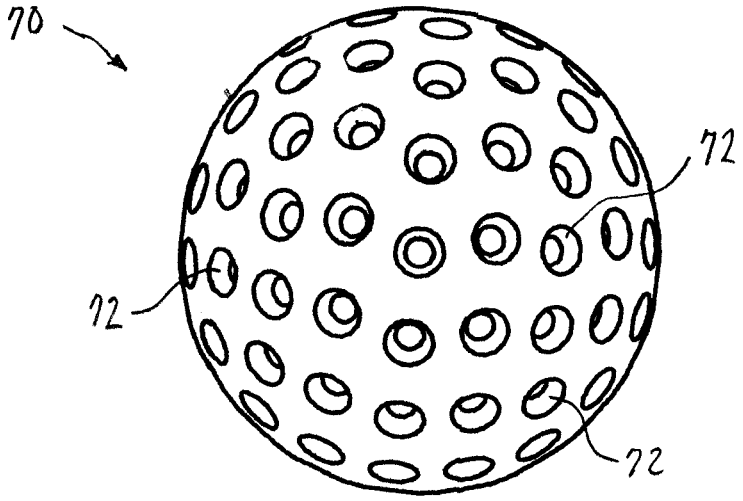
FIGS. 7A-B are diagrams that provide a perspective view and a cross-sectional side view, respectively, of a hollow, perforated ball that is disposed within the agitator.
Figure 7B:
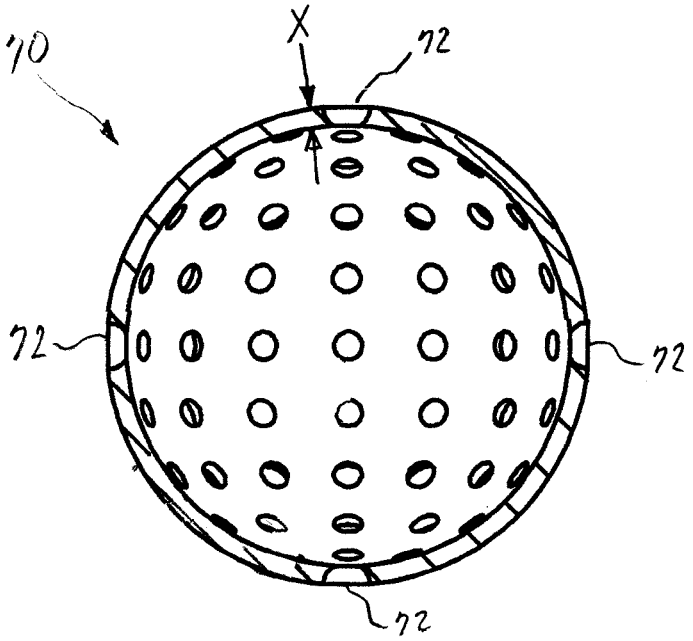

FIGS. 7A-B are diagrams that provide a perspective view and a cross-sectional side view, respectively, of a hollow, perforated ball 70 that is disposed within, and is in fact part of, the agitator 40 shown in FIGS. 1-3 and 6A-6B. In the embodiment shown, the numerous perforations 72 each have a concave outward profile. For example, each perforation 72 may resemble the dimples on a golf ball, yet have an opening in the center that allows exhaust gases and water droplets to pass into and out of the hollow, perforated ball 70. The perforations may also have other shapes, such as a frusto-conical shape, or a truncated polyhedron.

In reference to FIG. 7B, the ball 70 is shown having a spherical shape and a wall thickness "X". The hollow, perforated ball 70 is preferably made with light-weight material, such as a plastic or plastic composite, such that the ball will rise, fall and spin within the ball cage 44 shown in FIG. 6B. The movement of this light-weight, high surface area ball in the stream of flowing exhaust gases helps to prevent water droplets from passing through the agitator. Specifically, with the modular tailpipe riser 12 configured as shown in FIG. 2, the agitator 40 is substantially vertical, such that the hot exhaust gases are flowing upward through the agitator 40 and any water droplets in the riser 12 will be dropping downward under the force of gravity. If the droplets hit the hollow perforated ball 70 or one of the plurality of ribs 46, the flow of hot exhaust gases over and through the ball 70 and ribs 46 will tend to evaporate the water and/or entrain the water in the gases to be removed out the top of the riser 12.

Figure 8C:
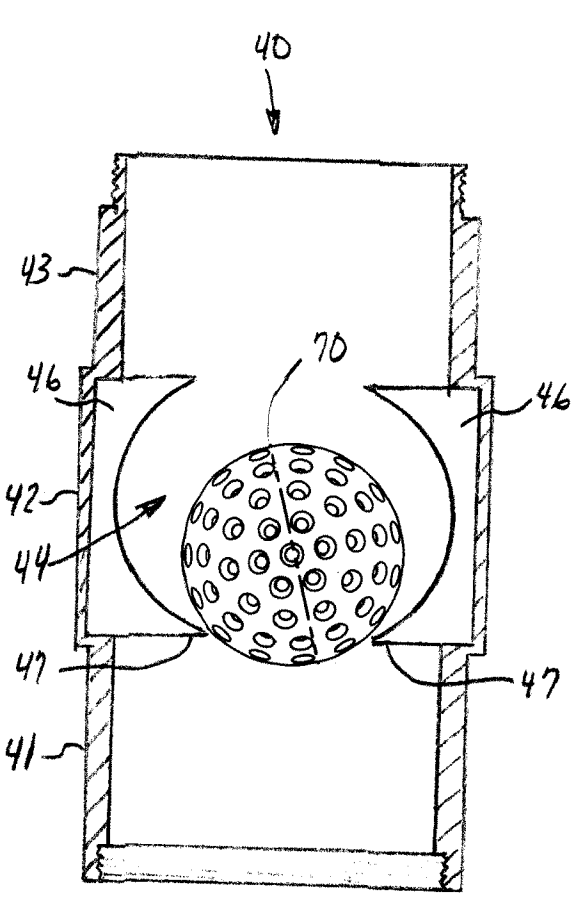
FIGS. 8A-C are cross-sectional diagrams of the agitator with the hollow, perforated ball disposed within a ball cage of the agitator and located in an upward position, an intermediate position and a downward position, respectively, of the ball cage.
Figure 8B:
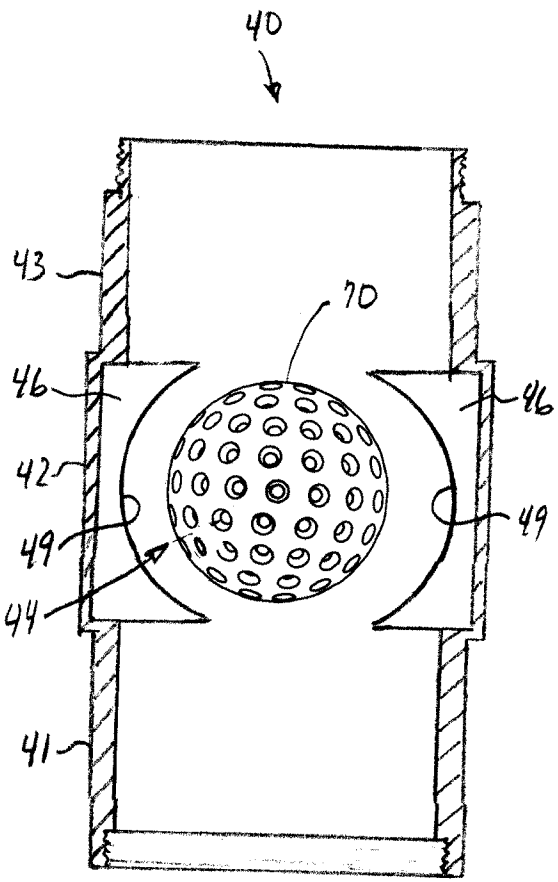
Figure 8A:
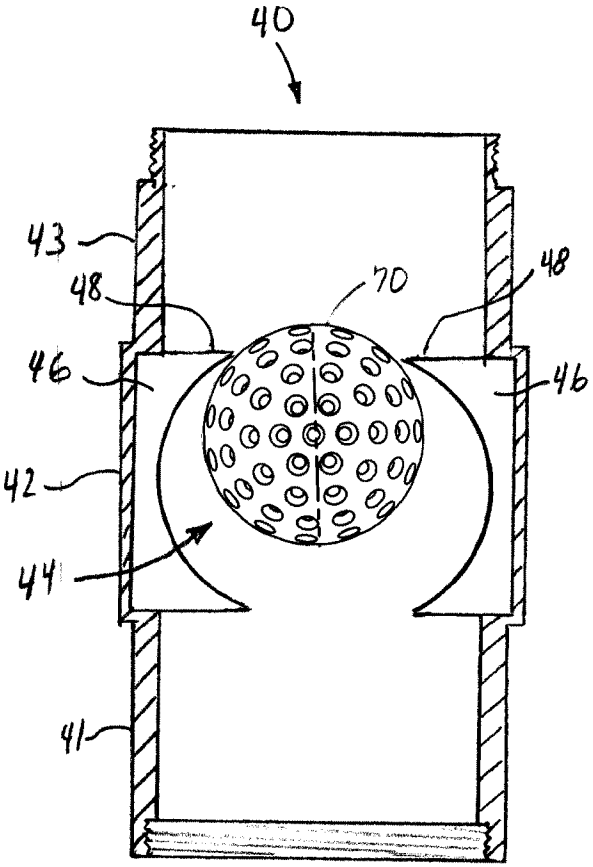

FIGS. 8A-C are cross-sectional diagrams of the agitator 40 with the hollow, perforated ball 70 disposed within the ball cage 44 of the agitator 40 and located in an upward position, an intermediate position and a downward position, respectively, of the ball cage 44. In FIG. 8A, the ball 70 is in an upward position where the ball 70 may engage with one or more of the second (upper) ends 48 of the ribs 46, such that the ball is retained within the ball cage 44. In FIG. 8B, the ball 70 is in an intermediate position where the ball 70 may move freely between the concave surfaces 49 of the ribs 46. For example, the ball may spin, move side-to-side and/or up and down. In FIG. 8C, the ball 70 is in an downward position where the ball 70 may engage with one or more of the first (lower) ends 47 of the ribs 46, such that the ball is retained within the ball cage 44.

Figure 9A:
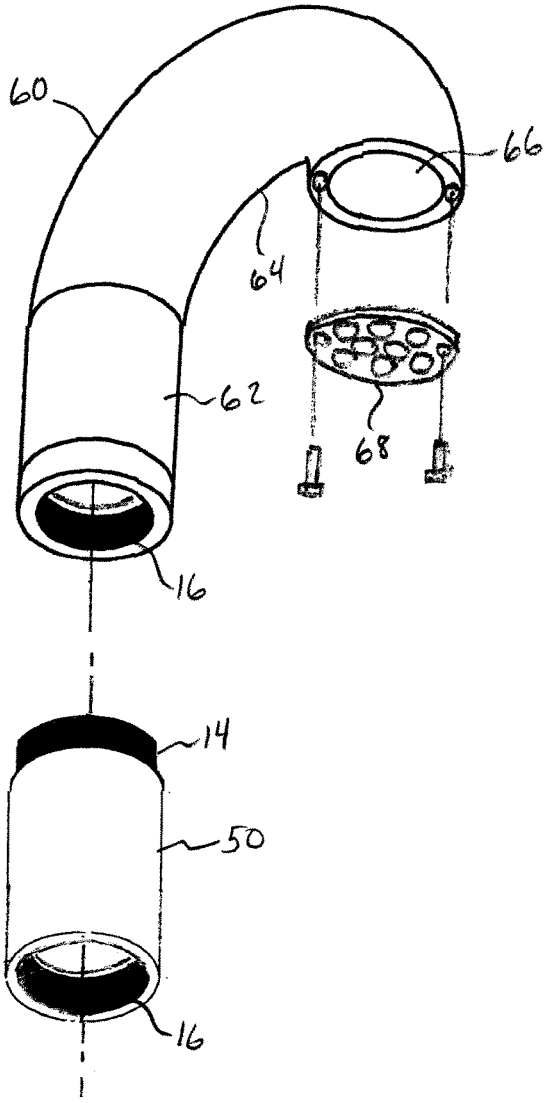
FIGS. 9A-B are diagrams providing perspective and cross-section side views, respectively, of both an extender and a weatherhead.
Figure 9B:
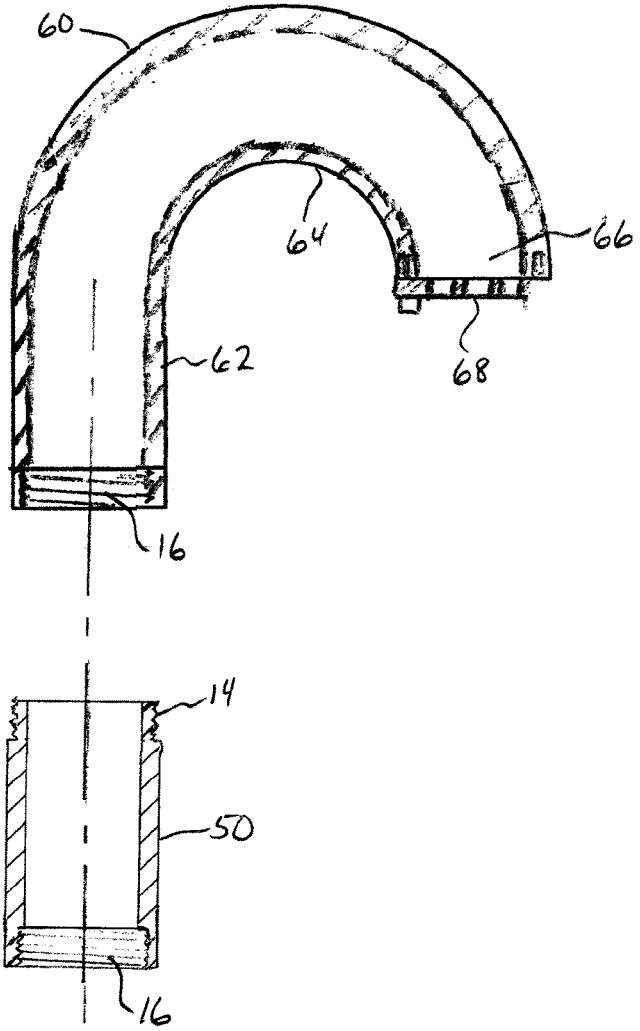

FIGS. 9A-B are diagrams providing perspective and cross-section side views, respectively, of both a riser extension 50 and a weatherhead 60. The riser extension 50 is a conduit module that may be substantially straight and serves the purpose of increasing the length (height) of the tailpipe riser. The length of the riser extension 50, and even the number of riser extensions 50 included in a modular tailpipe riser kit 10 (see FIG. 1), may vary, perhaps depending upon the make, model and/or type of automobile on which the modular tailpipe riser will be installed.

The weatherhead 60 has a generally straight neck portion 62 that includes internal screw threads 16 for selectively connecting to the riser extension 50 or other conduit module. The weatherhead 60 also has a curved portion 64 that terminated in an open end 66 that is generally downwardly directed. The downward directed open end 66 allows the exhaust gases to exit the modular tailpipe riser, but prevent rain from entering the weatherhead 60. An optional screen or grate 68 is shown being attached with screws to the open end 66 (see FIG. 9A) and after attachment to the open end 66 (see FIG. 9B). The screen or grate 68 preferably has a high degree of open area, such that debris is prevented from entering the weatherhead without cause any significant amount of resistance to the flow of exhaust gases from the weatherhead.

Figure 10A:
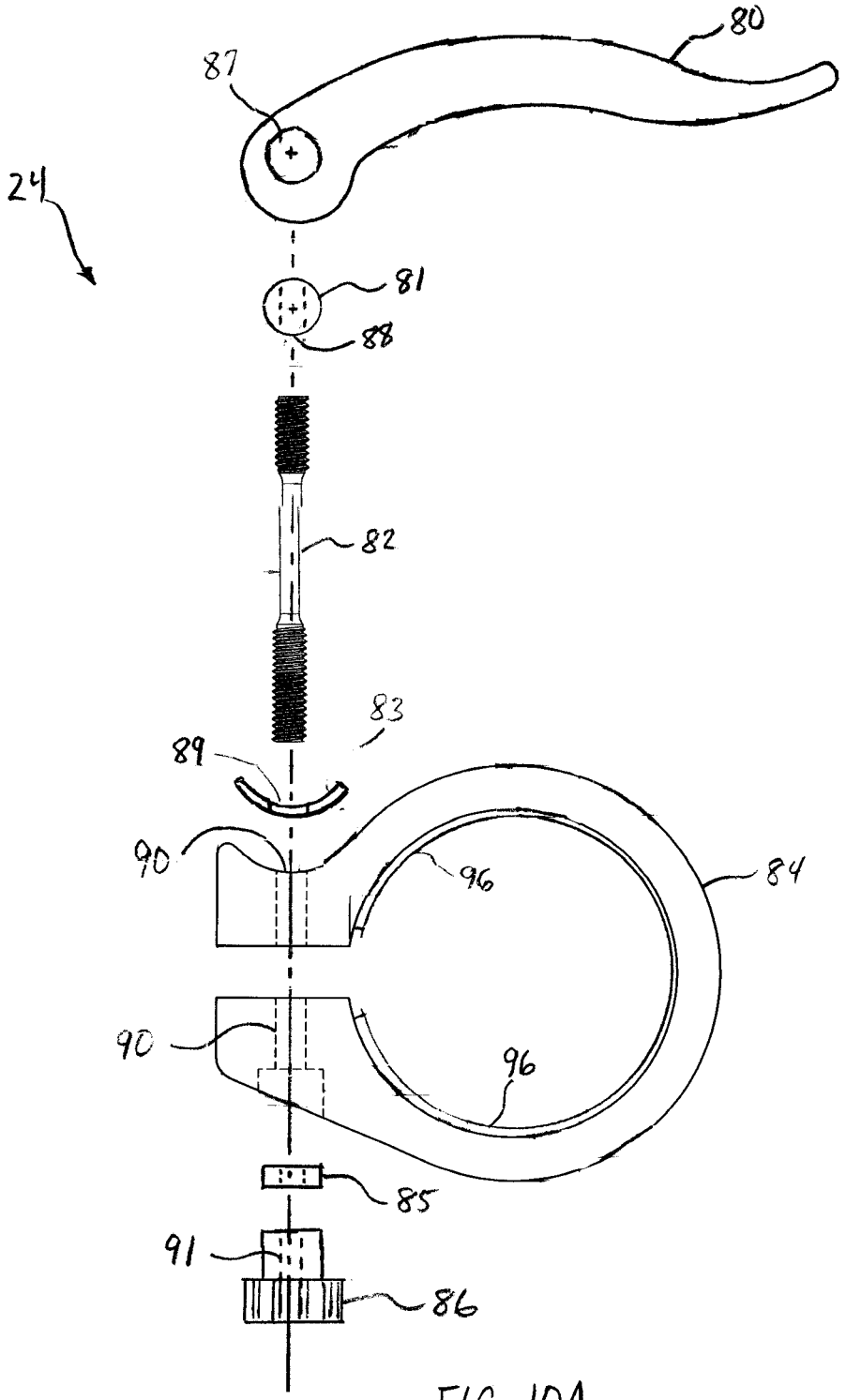
FIG. 10A is an assembly diagram of a quick release tube clamp.
Figure 10B:
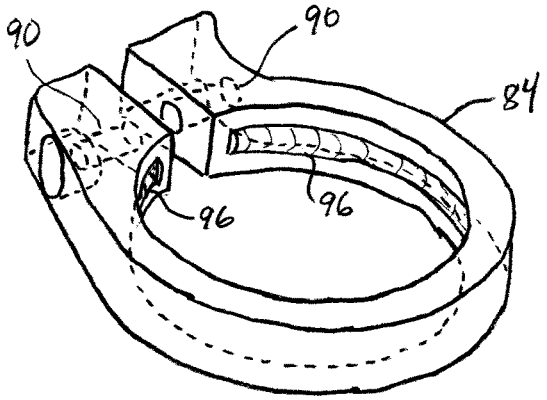
FIGS. 10B-G are diagrams of the individual parts of the quick release tube clamp.
Figure 10C:
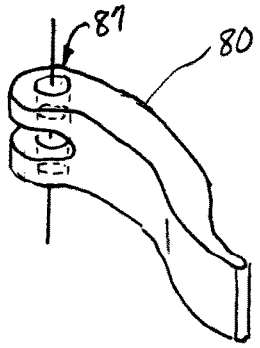
Figure 10D:
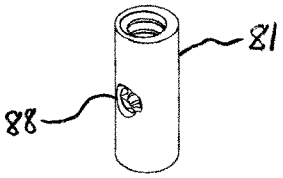
Figure 10E:
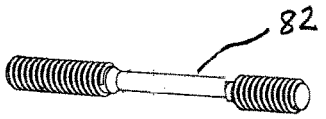
Figure 10F:
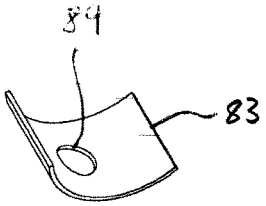
Figure 10G:
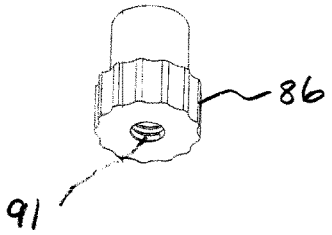

FIG. 10A is an assembly diagram of a quick release circumferential clamp 24. The clamp 24 includes a lever (handle) 80, a clamp nut 81, a bolt 82, a moon washer 83, a clamp body 84, a flat washer 85, and a clamp nut 86. The modular tailpipe riser kit 10 (of FIG. 1) preferably comes with the clamp fully assembled and perhaps also securely received on the tailpipe coupling 20 (of FIG. 1). However, the clamp may be assembly by extending the clamp nut 81 into a pivot hole 87 in the lever 80. One end of the bolt 82 may then be threaded into the side hole 88 of the clamp nut 81. A second end of the bolt 82 is passed through a hole 89 in the moon washer 83, through a hole 90 through two ends of the clamp body 84, through the flat washer 85, and threadably connects with the internal threads 91 of the clamp nut 86. FIGS. 10B-G are perspective views of the individual parts of the quick release tube clamp 24 showing a greater amount of detail. In reference to FIG. 10B, the clamp body 84 is shown including an optional o-ring 96 that fits into a groove in the inward face of the clamp body 84. The o-ring may serve to foster an additional degree of sealing and/or may give the clamp body a greater grip on the deflectable fingers of the tailpipe coupling. Alternative gasket types may also be secured to the inward fact of the clamp body.

Figure 11B:
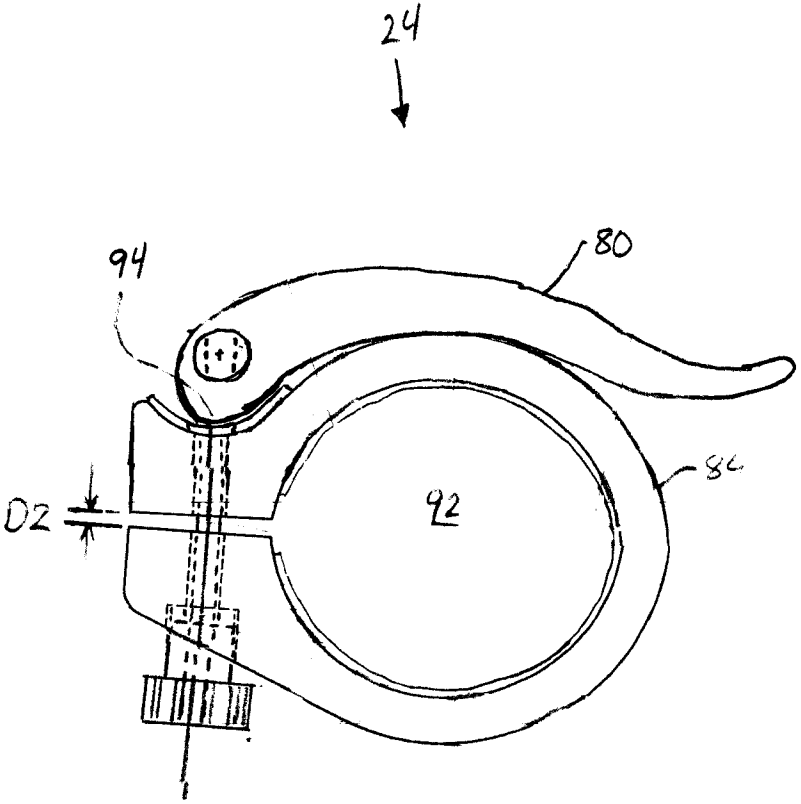
FIGS. 11A-B are diagrams of the quick release tube clamp in an open condition and a closed condition, respectively.
Figure 11A:
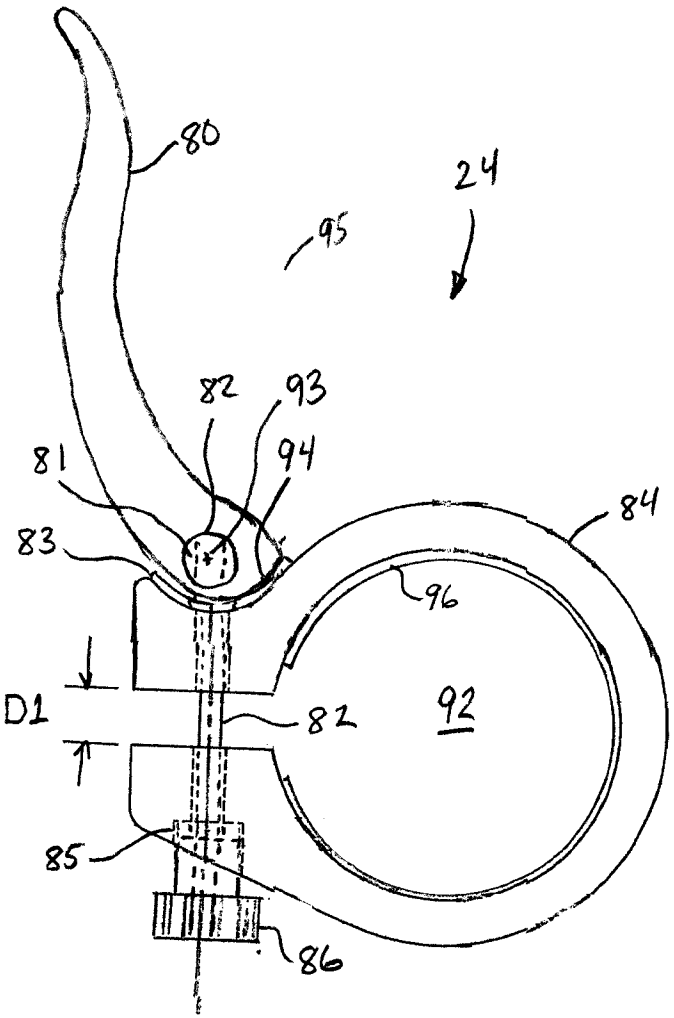

FIGS. 11A-B are diagrams of the quick release tube clamp 24 in an open condition and a closed condition, respectively. In FIG. 11A, the clamp 24 is in an open condition, meaning that the diameter of the clamp opening 92 is at its greatest. The clamp 24 should be in the open condition when being positioned about the tailpipe coupling and when the tailpipe coupling is being position about the tailpipe. The clamp nut 86 may be loosened or removed if it is necessary to further increase the clamp opening 92 so that it will fit onto the tailpipe coupling. The open condition of the clamp 24 is also shown by the distance "D1" between the opposing ends of the clamp body 84.

In FIG. 11B, the clamp 24 is in a closed condition, meaning that the diameter of the clamp opening 92 has been decreased. The closed condition of the clamp 24 is shown by the distance "D2" between the opposing ends of the clamp body 84. The final distance "D2" may be adjusted by turning the clamp nut 86. The clamp 24 is closed by moving the lever 80 from an outward position (shown in FIG. 11A) to an inward position (shown in FIG. 11B). The end of the lever 80 that has the opening 82 also has a cam surface 94 that engages the moon washer 83. The cam surface 94 has a gradually increasing radius about the axial centerline 93 of the opening 94. As the lever 80 is rotated about the clamp nut 81 in the direction of the arrow 95, the distance between the axial centerline 93 and the moon washer 83 increases. Since the length of the bolt 82 is fixed, the cam surface 94 pushes against the moon washer 83 such that the two ends of the clamp body 84 get closer together.

Figure 12A:
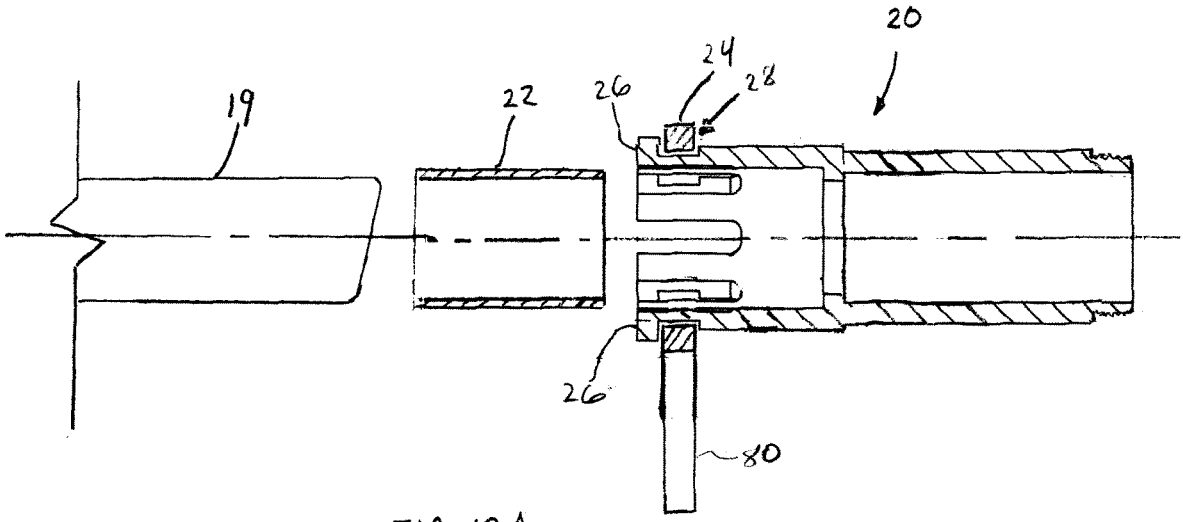
FIG. 12A is a diagram of a tubular gasket and coupling aligned with a tailpipe of an automobile and ready for installation.

FIG. 12A is a diagram of a tubular gasket 22 and tailpipe coupling 20 aligned with a tailpipe 19 of an automobile and ready for installation. The circumferential clamp 24 is received in a groove 28 form in the deflectable fingers 26 and has its lever 80 in an open condition. While FIGS. 12A-C do not show the rest of the modular tailpipe riser, it is possible to assembly the entire modular tailpipe riser prior to securing the tailpipe coupling 20 to the tailpipe 19.

Figure 12B:
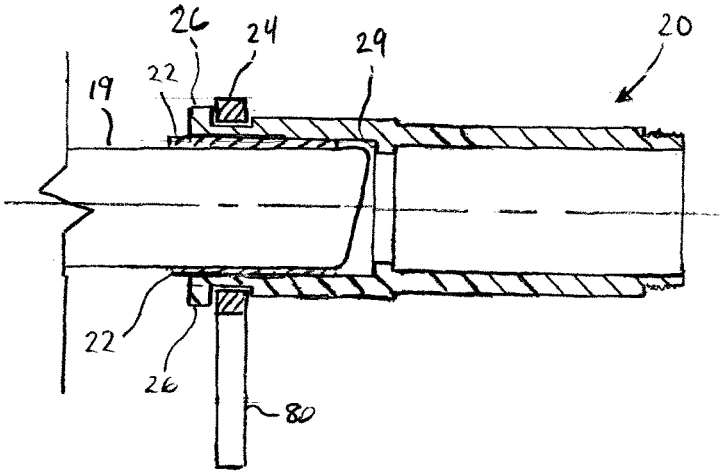
FIG. 12B is a diagram of the tubular gasket and the coupling in a position receiving the end of the tailpipe.

FIG. 12B is a diagram of the tubular gasket 22 and the tailpipe coupling 20 in a position receiving the end of the tailpipe 19. Preferably, the tailpipe coupling 20 is slid over the tubular gasket 22 and the tailpipe 19 until the distal end of the tailpipe 19 engages with the shoulder 29 inside the tailpipe coupling 20. While the distal end of the tailpipe 19 is shown have an angled end, the top portion of the distal end is near the shoulder 29.

Figure 12C:
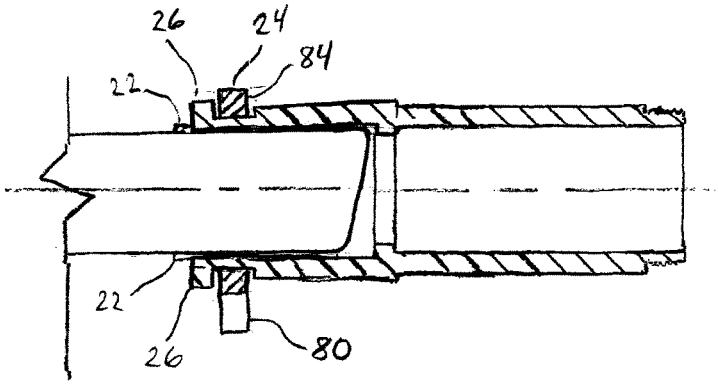
FIG. 12C is a diagram of the tubular gasket and the coupling after the quick release tube clamp has been closed to compress the tubular gasket between the coupling the tailpipe.

FIG. 12C is a diagram of the tubular gasket 22 and the tailpipe coupling 20 after the circumferential clamp 24 has been closed to compress the tubular gasket 22 between the deflectable fingers 26 of the tailpipe coupling 20 and the outer surface of the tailpipe 19. Note that the lever 80 is now in the closed position, the diameter of the clamp body 84 has decreased, the fingers 26 have been deflected inwardly, the gasket 22 has been compressed, and the tailpipe coupling 20 has been secured to the tailpipe 19.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. A modular tailpipe riser kit, comprising:

a plurality of conduit modules, wherein each conduit module is selectively connectable to at least one other conduit module to support flow of exhaust gases through connected conduit modules, the plurality of conduit modules including:

a tailpipe coupling having a first end and a second end, wherein the first end is receivable and selectively securable to the outer surface of a tailpipe of an automobile;

an elbow having a first end and a second end, wherein the first end of the elbow is selectively connectable to the second end of the tailpipe coupling; and a riser extension having a first end and a second end, wherein the first end of the riser extension is selectively connectable to the second end of the elbow; and a circumferential clamp that is receivable about the tailpipe coupling for selectively securing the tailpipe coupling about the outer surface of the tailpipe; and an agitator module including a ball cage and a hollow perforated ball retained within the ball cage, wherein the hollow perforated ball is able to move within the ball cage without escaping the ball cage.

2. The modular tailpipe riser kit of claim 1, wherein each of the conduit modules has at least one tubular cross-section.

3. The modular tailpipe riser kit of claim 2, wherein each of the conduit modules has screw threads for selectively connecting to an adjacent module.

4. The modular tailpipe riser kit of claim 1, wherein the tailpipe coupling has a first end having a plurality of deflectable fingers spaced about a circumference of the tailpipe coupling, wherein each deflectable finger has a width and a length that is greater than the width, wherein the circumferential clamp is receivable around the plurality of deflectable fingers.

5. The modular tailpipe riser kit of claim 4, wherein the plurality of deflectable fingers form a circumferential groove for securing the circumferential clamp in a position around the plurality of deflectable fingers.

6. The modular tailpipe riser kit of claim 1, wherein the elbow includes a knockout chamber that extends downward from the second end of the elbow to collect water.

7. The modular tailpipe riser kit of claim 6, further comprising:

a drain plug, wherein the knockout chamber has a downward distal end that is selectively sealed off by the drain plug.

8. The modular tailpipe riser kit of claim 1, further comprising:

a weatherhead having a first end selectively connectable to the riser extension, wherein the weatherhead is curved to have a second end that is vertically downwardly facing to deter rain drops from entering the modular tailpipe riser.

9. The modular tailpipe riser kit of claim 1, further comprising:

one or more additional riser extensions that may be used interchangeably with the riser extension or used in combination with the riser extension.

10. The modular tailpipe riser kit of claim 1, further comprising:

a compressible tubular gasket that is positionable between the outer surface of the tailpipe and an inner circumference of the first end of the tailpipe coupling.

11. The modular tailpipe riser kit of claim 1, wherein the conduit modules may be assembled and secured to the tailpipe to extend the conduit behind the automobile and upward behind the automobile to a height above a bumper on the automobile.

12. The modular tailpipe riser kit of claim 1, wherein the circumferential clamp is manually operable without tools and the plurality of conduit modules are manually connectable without tools.

13. The modular tailpipe riser kit of claim 1, further comprising:

a weatherhead having a first end selectively connectable to the riser extension, wherein the weatherhead is curved to have a second end that is downwardly facing to deter rain drops from entering the modular tailpipe riser; and a screen attached to the second end to prevent debris from entering the weatherhead.

14. A modular tailpipe riser kit, comprising:

a plurality of conduit modules, wherein each conduit module is selectively connectable to at least one other conduit module to support flow of exhaust gases through connected conduit modules, the plurality of conduit modules including:

a tailpipe coupling having a first end and a second end, wherein the first end is receivable and selectively securable to the outer surface of a tailpipe of an automobile;

an elbow having a first end and a second end, wherein the first end of the elbow is selectively connectable to the second end of the tailpipe coupling;

a riser extension having a first end and a second end, wherein the first end of the riser extension is selectively connectable to the second end of the elbow;

a circumferential clamp that is receivable about the tailpipe coupling for selectively securing the tailpipe coupling about the outer surface of the tailpipe; and an agitator module including a ball cage and a hollow perforated ball retained within the ball cage, wherein the hollow perforated ball is able to move within the ball cage without escaping the ball cage, wherein the ball cage includes a plurality of ribs radially inwardly extending from the internal side wall of the agitator, wherein the inward facing surface of each rib is concave between a first distal end and a second distal end.

15. A tailpipe riser, comprising:

a conduit having a first end that forms a tailpipe coupling that is receivable and selectively securable to the outer surface of a tailpipe of an automobile, an intermediate section that bends upward and extends to a second end at an elevation above a bumper of the automobile, and a circumferential clamp that is receivable about the tailpipe coupling for selectively securing the tailpipe coupling about the outer surface of the tailpipe;

a ball cage disposed in an upwardly extending portion of the intermediate section of the conduit; and a hollow perforated ball retained within the ball cage, wherein the hollow perforated ball is able to move within the ball cage without escaping the ball cage.

16. The tailpipe riser of claim 15, wherein the tailpipe coupling has a first end having a plurality of deflectable fingers spaced about a circumference of the tailpipe coupling, and wherein the plurality of deflectable fingers form a circumferential groove for securing the circumferential clamp in a position around the plurality of deflectable fingers.

17. The tailpipe riser of claim 15, further comprising:

a knockout chamber that extends downward below the elevation of the tailpipe to collect water that enters the conduit; and a drain plug, wherein the knockout chamber has a downward distal end that is selectively sealed off by the drain plug.

18. The tailpipe riser of claim 15, further comprising:

a weatherhead having a first end selectively connectable to the riser extension, wherein the weatherhead is curved to have a second end that is downwardly facing to deter rain drops from entering the modular tailpipe riser.

* * * * *